United States Patent [19]

Lustig

[11] Patent Number: 4,509,045

[45] Date of Patent: Apr. 2, 1985

[54] LOW COST ADDRESSING SYSTEM FOR AC PLASMA PANELS

[75] Inventor: Claude D. Lustig, Lexington, Mass.

[73] Assignee: Sperry Corporation, New York, N.Y.

[21] Appl. No.: 394,364

[22] Filed: Jul. 1, 1982

[51] Int. Cl.[3] ..... G09G 3/00

[52] U.S. Cl. ..... 340/794; 340/781; 250/213 A; 357/32; 307/311

[58] Field of Search ..... 340/794, 753, 754, 758, 340/768, 770, 718, 719, 776, 777, 781; 250/213 A; 307/311; 357/32; 313/506, 507; 361/228

[56] References Cited

U.S. PATENT DOCUMENTS

| | | | |
|---|---|---|---|
| 3,078,373 | 2/1963 | Wittenberg | 340/794 X |
| 3,270,206 | 8/1966 | Kazan | 250/213 A |
| 3,761,768 | 9/1973 | Schmersal | 340/776 X |
| 3,894,264 | 7/1975 | Andoh et al. | 340/777 X |
| 3,900,883 | 8/1975 | Hasegawa et al. | 357/32 |
| 3,940,757 | 2/1976 | Purchase | 340/794 X |
| 4,467,325 | 8/1984 | Lustig | 340/781 X |

*Primary Examiner*—Marshall M. Curtis
*Assistant Examiner*—Vincent P. Kovalick
*Attorney, Agent, or Firm*—Howard P. Terry

[57] ABSTRACT

A flat panel display system for use with AC plasma panels in which addressing signals for an AC plasma panel display line is taken from a voltage divider comprised of two photoresistors, a coupling photoresistor and a decoupling photoresistor. Addressing pulses are coupled to the coupling photoresistor and sustaining voltage signals are coupled to the AC line via a capacitor which shunts the decoupling photoresistor. The coupling and decoupling photoresistors are illuminated in turn. The decoupling photoresistors, will upon illumination accelerate the decay of voltages appearing across the coupling photoresistor and on the AC plasma panel display line.

6 Claims, 6 Drawing Figures

LOW COST ADDRESSING SYSTEM FOR AC PLASMA PANELS

BACKGROUND OF THE INVENTION

1. Field of the Invention

This invention pertains to the field of flat panel displays and more specifically to an AC plasma flat panel display that utilizes electrooptic techniques to minimize the required addressing circuitry.

2. Description of the Prior Art

Flat panel displays are useful for the display of alphanumeric and graphic information in applications including computer readouts, plotting and tracking displays and the like. Such displays are lighter in weight than CRT displays and due to their flat panel construction may be placed in consoles having a more limited depth than that required for CRTs. Most flat panel displays utilize an array of small discrete electrosensitive areas known as pixels that either generate light or reflect light in response to an electrical signal. The pixels may comprise AC or DC electroluminescent materials, gas discharge cells, light emitting diodes, liquid crystals, etc., and may be addressed either individually, or in a matrix array with half select techniques. Displays of practical size, however, require a large number of addressing circuits even when organized in a matrix array, thereby significantly increasing the cost and complexity of the resulting display system. For example, a flat panel display containing 10,000 pixels in a one hundred by one hundred row and column configuration would require up to 10,000 individual circuits for each pixel in a direct addressing system. Most matrix organized flat panel displays, however, utilize a row and column addressing system in which the pixels in an individual row have a lead in common, and the pixels in each column also have a lead in common. Thus, by addressing the appropriate column and row, individual pixels may be energized. For the previous example of a one hundred by one hundred matrix display, two hundred addressing circuits would be required, one hundred for the rows and one hundred for the columns. It is, however, desirable to reduce this number further.

Applicant's copending application Ser. No. 317,688 assigned to the assignee of the present invention describes an apparatus that provides a greatly reduced number of addressing circuits for use with display media that have a steep brightness voltage threshold, such as, for example, electroluminescent materials. Electroluminescent materials have no inherent memory and, therefore, require repeated application of addressing pulses to refresh displayed information. AC plasma panels have an inherent memory and, therefore, do not require repeated application of addressing pulses. Provision, however, must be made to apply sustaining voltage waveforms to utilize this inherent memory characteristic. The present invention provides flat panel displays having a greatly reduced number of addressing circuits in combination with AC plasma panel having inherent memory.

SUMMARY OF THE INVENTION

An AC plasma flat panel display embodying the principles of the present invention comprises individual coupling and decoupling photoresistors for each AC plasma panel display line from the junction of which is taken a drive signal for a display line. An addressing pulse source is coupled to the coupling photoresistor which is illuminated by a light source to lower its resistance thereby coupling the addressing pulse to the AC plasma panel display line selected by illumination of the appropriate coupling photoresistor. A sustaining voltage source which supplies the voltage that is necessary to sustain a glow in the AC plasma panel is also coupled via a capacitor to the AC plasma panel display line and the capacitor is in turn shunted by a decoupling photoresistor which when illuminated reduces the addressing pulse on the decoupling photoresistor's line to the voltage level of the sustaining voltage source, effectively accelerating the decay time of the coupling photoresistor.

DESCRIPTION OF THE PREFERRED EMBODIMENT

Figure 1:
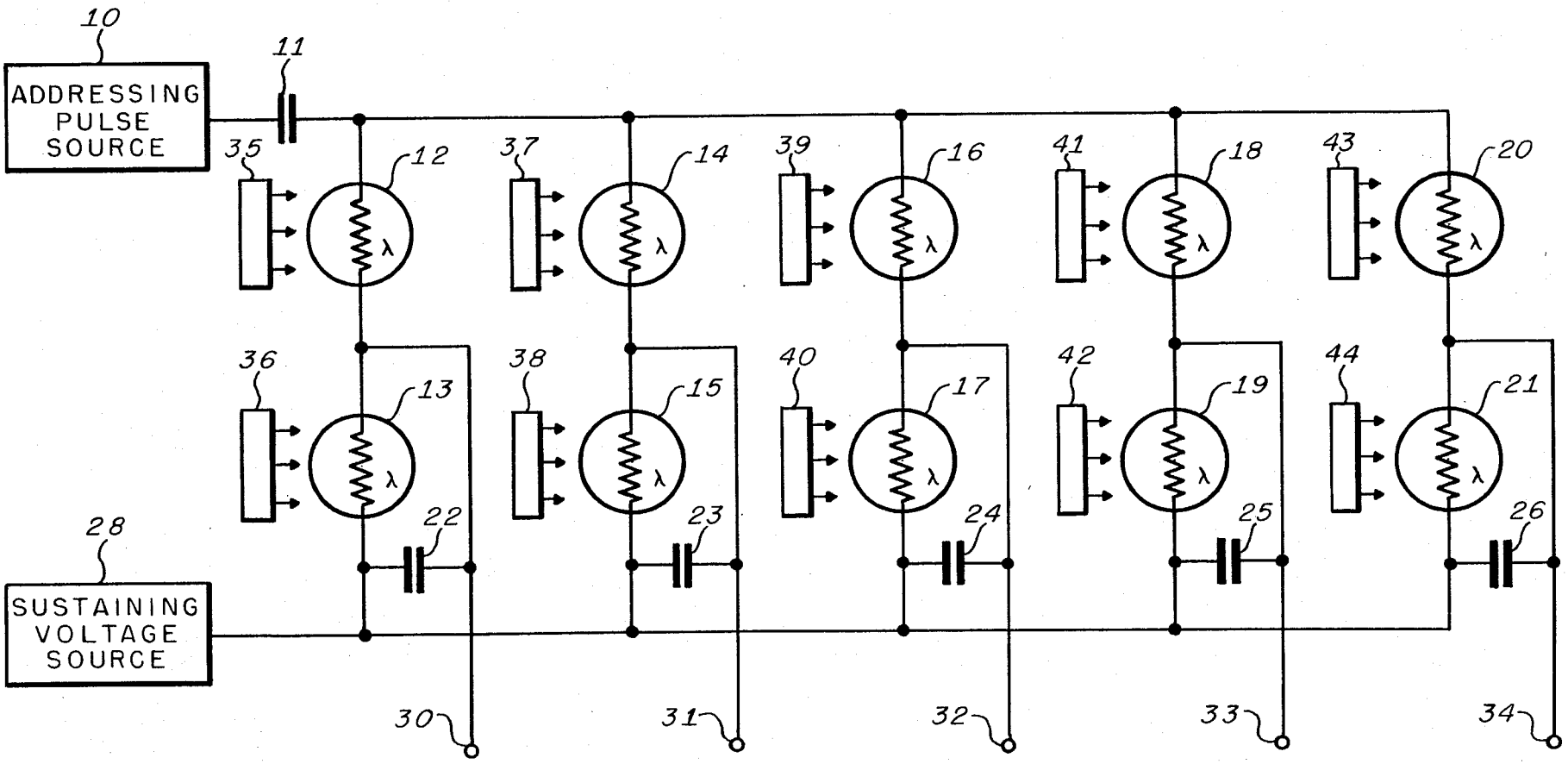
FIG. 1 is a schematic representation of the addressing system of the present invention.

Referring to FIG. 1, a flat panel display addressing scheme for use with an AC plasma panel is shown, including addressing pulse source 10 coupled by a coupling capacitor 11 to a parallel series of five resistive divider networks comprised of pairs of photoresistors 12 and 13, 14 and 15, 16 and 17, 18 and 19, and 20 and 21 respectively. Capacitors 22, 23, 24, 25, and 26 shunt photoconductors 13, 15, 17, 19, and 21, respectively. The junction of photoconductors 12 and 13 and capacitor 22 are further coupled to a terminal 30 which is, in turn, coupled to a first line of an AC plasma display panel to be described in further detail hereinbelow. Similarly, the remaining junctions of the photoconductor pairs and shunting capacitors are coupled to terminals 31, 32, 33, and 34 which are, in turn, coupled to additional lines of an AC plasma display panel. The junction of the photoconductor 13 and capacitor 22 not coupled to photoconductor 12, as well as the similar junctions of the remaining photoconductors and capacitors are further coupled to each other and to sustaining voltage source 28. Light sources 35, 36, 37, 38, 39, 40, 41, 42, 43, and 44 are used to illuminate the photoconductors 12 through 21, respectively, at the appropriate time, as will be further described hereinbelow. Light sources 35 through 44 may beneficially be derived from a self-scanning gas discharge tube to provide sequential illumination of the adjacent photoresistors with a minimum of drive circuitry in commercially available, compact, packages. One discharge light source operating on the scanning principle is the Burroughs BG16101-2 Dual Linear Bargraph Display, manufactured by the Burroughs Corporation, Electronic Components Division, P.O. Box 1226, Plainfield, N.J. 07061. In these self-scanning gas discharge tubes, a glow transfer mechanism is used to shift a luminous glow repeatedly along an array of small cathode elements. The tubes require only four drivers, one of which is used for a scan initiate function.

Figure 2:
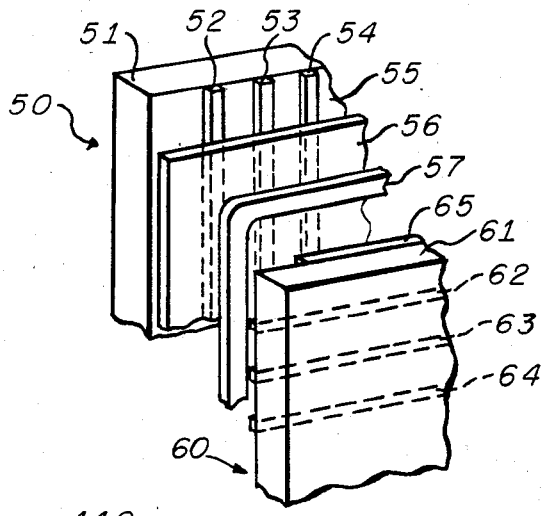
FIG. 2 illustrates the construction of an AC plasma panel.

Referring to FIG. 2, an AC plasma panel having what is known in the art as an "open cell" construction is shown. First plate 50, consisting of glass substrate 51 has vertical, parallel electrodes 52, 53, and 54 deposited thereon, which electrodes are in turn covered by a layer of dielectric glass 56 and sealed together with a second plate 60. Second plate 60 has essentially similar construction to first plate 50 and comprises glass substrate 61 on which are deposited horizontal parallel electrodes 62, 63, and 64 which are, in turn, covered by dielectric glass 65. Plates 50 and 60 are sealed together using seal 57 and oriented so that the parallel electrodes 52, 53 and 54 are aligned at right angles to parallel electrodes 62, 63 and 64. The space between dielectrics 56 and 65 contains a gas, such as neon, that is contained by seal 57 and plates 50 and 60. In the addressing system of FIG. 1, vertical electrodes 52, 53 and 54 are coupled to terminals 30, 31 and 32, respectively. It will be appreciated by those skilled in the art that similar addressing circuits may be used in conjunction with horizontal electrodes 62, 63 and 64. It will further be appreciated by those skilled in the art that the number of elements shown in FIG. 1 may be increased as desired to address plasma panels of any desired size and complexity.

In operation a sustaining voltage is applied to all vertical and horizontal parallel electrodes in the matrix array. The amplitude of this voltage is adjusted to a level which is insufficient to cause the gas within the panel to initially break down in the absence of an internal wall charge at the dielectric. To turn a selected cell on, a pulse of proper amplitude and timing is superimposed on a sustaining waveform at the appropriate intersection of the vertical and horizontal electrodes. The combined voltage at the appropriate intersection of the vertical and horizontal electrodes will exceed the breakdown voltage of the gas utilized in the cell resulting in ionization at that point. The ionized gas will emit a visible light which will appear as a spot at the intersection of the selected electrodes. When there is a voltage on the external electrodes the high electron and ion currents then cause a glow during the gas breakdown and build up a charge on the cell walls with a polarity of charge in a direction opposed to the applied voltage. As the discharge extinguishes, the wall charge remains while the sustaining voltage reverses direction. The wall charge voltage then adds to the reversed applied sustaining voltage on the external electrodes so that the net voltage across the cell again exceeds the breakdown potential and the area continues to glow. The process is repeated every half cycle.

Figure 3:
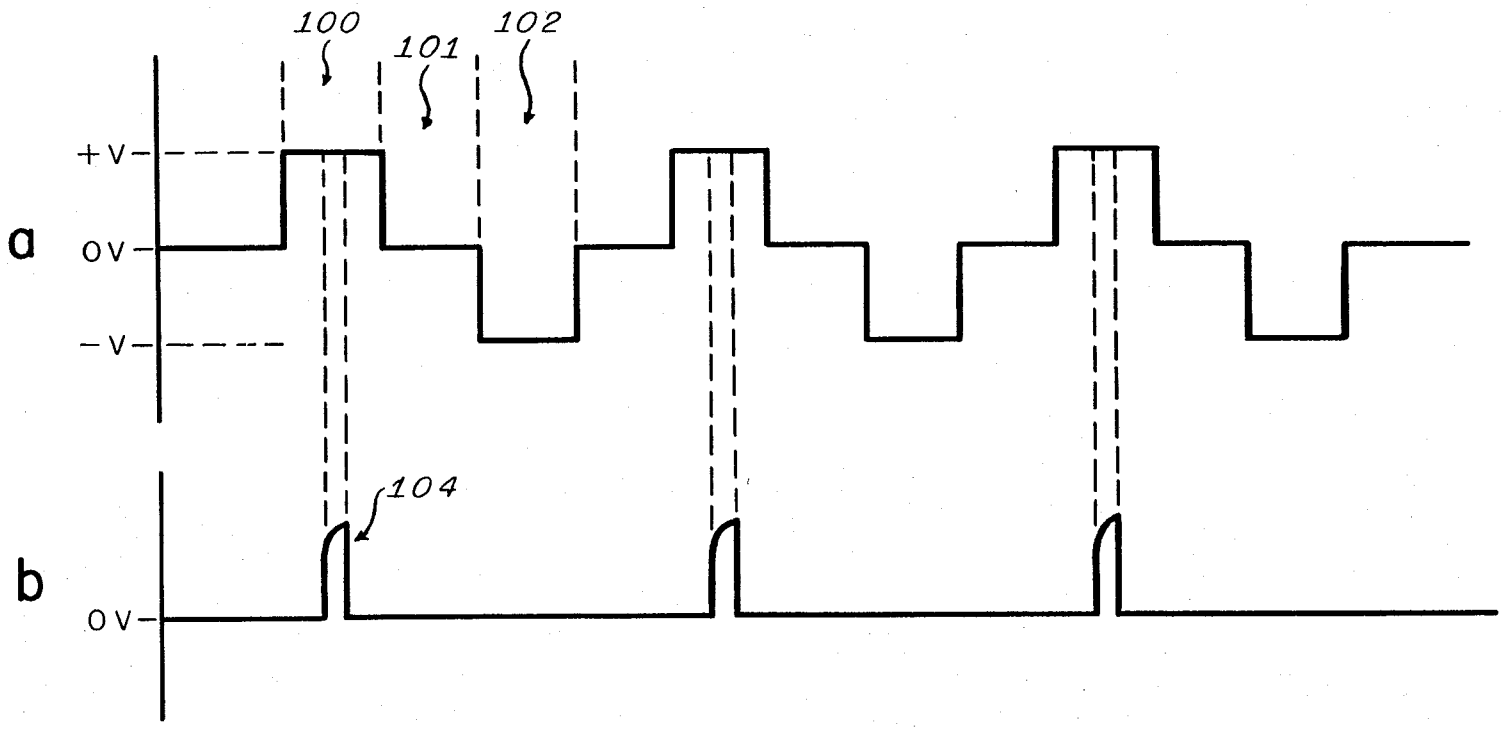
FIG. 3 shows waveforms useful in explaining the operation of the invention.

Refer now to FIG. 3. FIG. 3*a* shows sustaining voltage waveforms needed to take advantage of the inherent memory of AC plasma display devices. As previously described, the sustaining voltage will swing from +V to −V having a level period at 0 volts between voltage swings. These voltages, in combination with the wall charge voltage, will maintain a glow at a given area of the plasma cell. Regions 100, 101, and 102 may have, for example, durations of five microseconds each. In FIG. 3B, addressing pulses are shown which generally are chosen to occur during one of the periods of peak voltage such as region 100 to address each given pixel in the plasma panel as described above. Each addressing pulse, such as pulse 104, may have, for example, a width of approximately one microsecond.

Refer again to FIG. 1. The circuitry associated with display line 52 of FIG. 2 coupled at terminal 30 and comprising photoconductors 12 and 13 and capacitor 22 operates as follows. Light source 35 is used to illuminate photoconductor 12 whose resistance falls rapidly from a high dark value resistance to a lower illuminated resistance.

Figure 4:
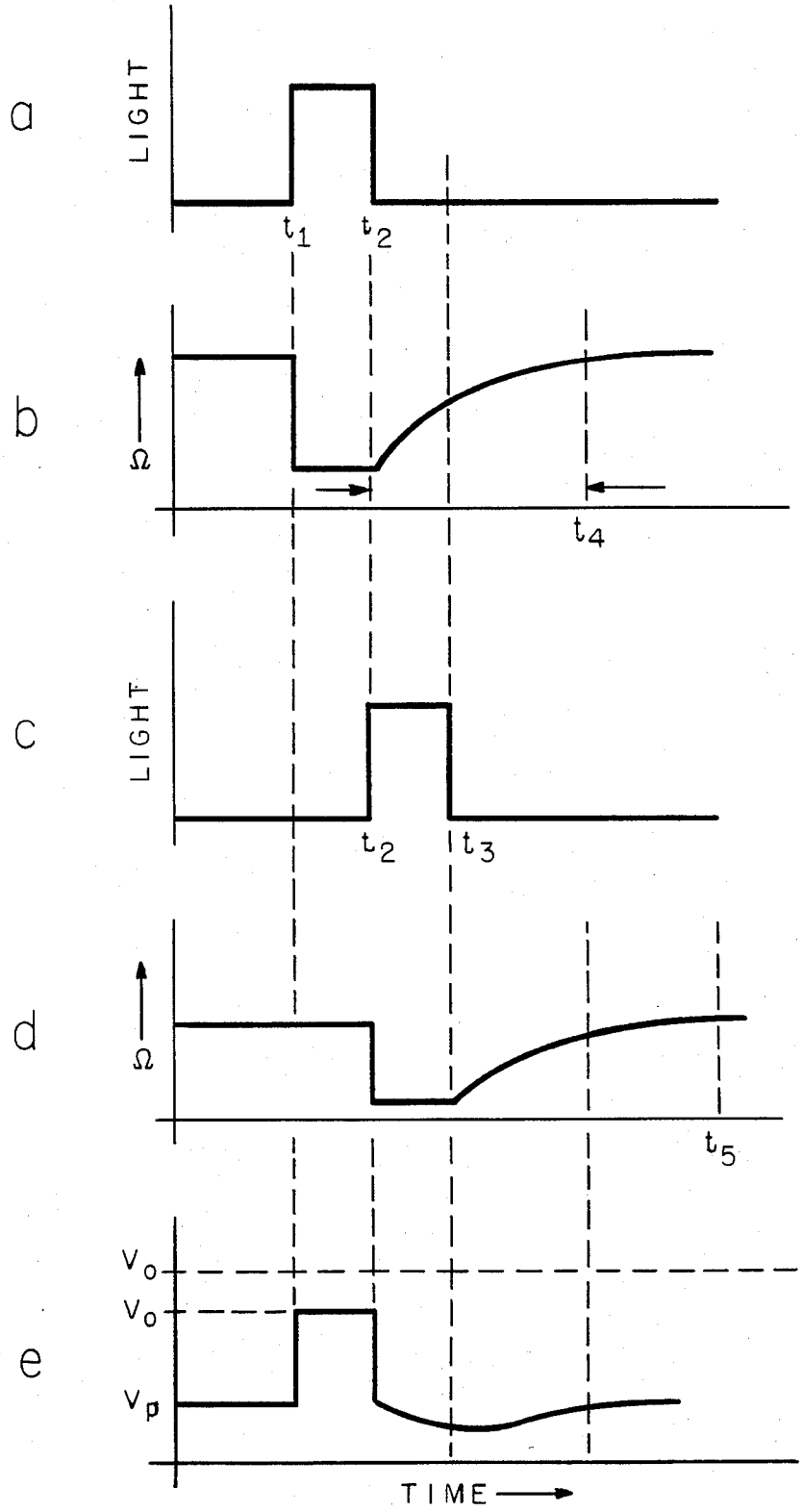
FIG. 4 shows waveforms useful in explaining the operation of the invention.

Referring now to FIGS. 1 and 4, in operation photoresistor 12 is illuminated by a light pulse from light source 35 beginning at time $t_1$ and ending at time $t_2$ as shown by waveform 4*a*. Photoresistor 12 will exhibit a resistance shown in FIG. 4*b* having a decay time such that the photoresistor 12 does not return to substantially its dark resistance until time $t_4$. Photoresistor 13 is illuminated with a light pulse beginning at time $t_2$ and ending at time $t_3$as shown in FIG. 4*c*. The resistance exhibited by photoresistor 13 under such conditions of illumination is shown in FIG. 4*d* and decays in a manner similar to that shown for photoresistor 12 in FIG. 4*b*, such that its resistance does not substantially return to the dark resistance value until time $t_5$. FIG. 4*e* shows the resultant voltage that does appear at terminal 30. The variable resistance of photoresistor 13 has the effect of shunting voltage appearing across photoresistor 12 to the potential at sustaining voltage source 28 thus decoupling voltages appearing across photoresistor 12 from lead 30 when decoupling photoresistor 13 is illuminated. In this manner, the voltage pulse shown in FIG. 4*e*, which appears at terminal 30, is substantially similar to the initial light pulse used to illuminate the photoresistor 12 as shown in FIG. 4*a*.

Resistances of coupling photoresistor 12 and decoupling photoresistor 13 are not identical, the resistance of photoresistor 12 being greater than that of photoresistor 13. For an input voltage $V_O$, the output voltage of this divider circuit may be stated as $$V = V_o \frac{R'(t)}{R(t) + R'(t)}$$

where R'(t) is equal to the resistance of photoresistor 13 and R(t) is equal to the resistance of photoresistor 12. It will be clear to those skilled in the art that proper selection of the resistance values and illumination levels for photoresistors 12 and 13 will yield an optimum ratio of pulse amplitude $V_p$ to baseline value $V_b$ as shown in FIG. 4*d*.

The values of capacitors 11 and 22 through 26 must be chosen so that two conditions are fulfilled; (1) the sustaining voltage amplitude appearing on the display lines must be substantially the same for all lines, for all resistance values of the photoresistors; and (2) addressing pulses must appear with a high amplitude on the display lines for which they are intended but with a relatively low value on all other lines. Referring to FIG. 1, values of the photoresistors and capacitors may be chosen as follows. The value of capacitor 11 is chosen to provide a small impedance for coupling addressing pulses having a pulse width of approximately 1 microsecond. The values of capacitors 22 through 26 are chosen to allow rapid charging of the display panel capacitance, at those times when the resistances of the decoupling photoresistors have decayed to a large value. At these times, the sustaining voltage waveform appearing on the display electrodes connected to the terminals 30 through 34 would depart significantly from a square wave if the display panel capacitance is charged only through a decoupling photoresistor. The values of the photoresistors are chosen so that the light resistance of the photoresistors coupling the display lines to the addressing pulse source is approximately three times the light resistance of the photoresistors which decouple the display lines after the addressing pulses have been applied. Furthermore, a light to dark ratio of approximately 33 may be used for all photoresistors under the illumination conditions existing during panel addressing.

Operation of the invention may be further understood by considering the following exemplary values of the photoresistors for varying conditions. Photoresistors 12 and 13 which have values of 100 kilohms and 33 kilohms, respectively, are in a dark condition such as would occur after a long time has elapsed; these photoresistors were illuminated in the addressing cycle and then their resistance has decayed to their dark value. The AC plasma display line coupled to terminal 34 would represent the display line being addressed so that coupling resistor 20 is illuminated and consequently has a low resistance value of 3 kilohms. Decoupling photoresistor 21 has not yet been illuminated and exhibits a dark resistance value of 33 kilohms. The display line coupled to terminal 33 is in the process of being decoupled and therefore its coupling photoresistor 18 is no longer illuminated but has just started decaying, having a value of 3 kilohms whereas decoupling photoresistor 19 is now illuminated and has a value of 1 kilohm. The display lines coupled to terminals 32 and 31, respectively, represent lines whose photoresistors were illuminated at some time previously with their resistance values decaying back to their dark values. In such an instance photoresistors 14, 15, 16 and 17 may be expected to have values of 33 kilohms, 11 kilohms, 12 kilohms, and 4 kilohms, respectively. As stated hereinabove, addressing pulse source 10 and sustaining voltage 28 are synchronized as described for FIG. 4 and, therefore, provide the necessary combination of waveforms to utilize the memory feature of the AC plasma panel. It will be clear to those skilled in the art that erasure may be provided by operating the addressing and sustaining voltage with opposite amplitude polarity instead of as is shown in FIG. 4 where they have the same amplitude polarity.

Figure 5A:
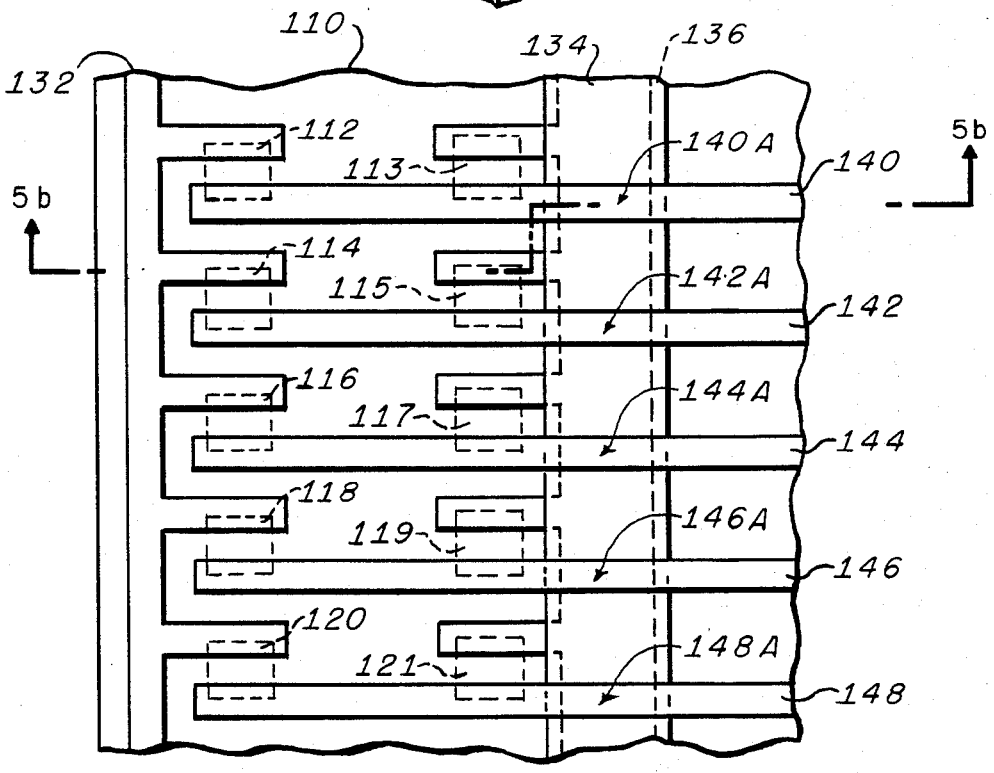
FIGS. 5A and 5B show the construction of one embodiment of the invention.
Figure 5B:
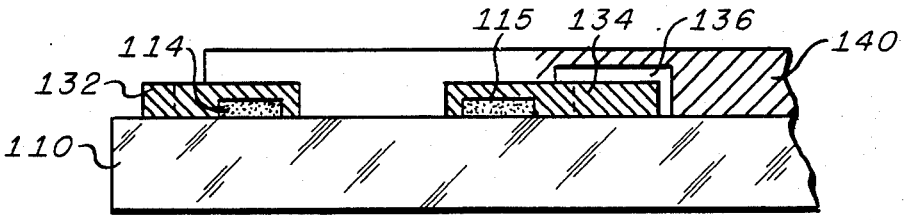

The nature of the photoconducting material and AC plasma panel materials permits particularly simple and inexpensive fabrication of the desired display panel. FIG. 5*a* shows a view from the display side of such a panel and FIG. 5*b* shows a cross-sectional view of the display panel taken through section 5*b*—5*b*. The display panel includes a substrate 110 which may be comprised of glass or another dielectric on which a photoconductive material such as cadmium sulfide or cadmium selenide is deposited in areas 112, 113, 114, 115, 116, 117, 118, 119, 120 and 121. The photoconductive areas indicated by 112, 114, 116, 118, and 120 form coupling photoresistors 12, 14, 16, 18, and 20, while the photoconductors 113, 115, 117, 119, and 121 form decoupling photoresistors 13, 15, 17, 19, and 21 in association with their corresponding electrodes described hereinbelow. Electrodes 132 and 134 are each deposited on the substrate 110, electrode 132 having regions extending therefrom deposited over a portion of the coupling photoconductors and electrode 134 having regions extending therefrom which regions are deposited over the decoupling photoresistors. A dielectric layer 136 is deposited over a portion of electrode 134. Horizontal electrodes 140, 142, 144, 146, and 148 are deposited over substrate 110, dielectric 134 and the appropriate coupling and decoupling photoconductors. It will be seen that capacitors corresponding to capacitors 22, 23, 24, 25, and 26 are formed in regions 140*a*, 142*a*, 144*a*, 146*a*, and 148*a* by the combination of the horizontally extending electrodes, dielectric 136 and electrode 134. It will be clear to those skilled in the art that the value of the capacitors will be determined by the area of electrodes 134 and the thickness and composition of dielectric 136. Electrode 134 is coupled to sustaining voltage source 28. Horizontally extending electrodes 140, 142, 144, 146, and 148 correspond to terminals 30, 31, 32, 33 and 34, respectively. Although the layers described herein are shown in FIG. 5B as occupying given levels it will be recognized that in actual fabrication these layers may be conformally deposited.

While the invention has been described in its preferred embodiments, it is to be understood that the words which have been used are words of description rather than limitation and that changes may be made within the purview of the appended claims without departing from the true scope and spirit of the invention in its broader aspects.

I claim:

1. An improved flat panel display of the type having an AC plasma display panel with individual display lines therein comprising:

means for providing addressing pulse signals;

a plurality of coupling photoresistors coupled to said addressing pulse means;

a plurality of decoupling photoresistors, each of said decoupling photoresistors coupled to a corresponding one of said plurality of coupling photoresistors;

a plurality of shunt capacitors coupled in shunt relationship with a corresponding one of said decoupling photoresistors;

a sustaining voltage source means coupled to said decoupling photoresistors for providing sustaining voltage pulses in synchronism with said addressing pulses;

a plurality of output terminals coupled to the junction of said coupling and decoupling photoresistors and said shunt capacitors, each of said output terminals being coupled to a one of said AC plasma panel display lines;

means including a plurality of coupling light sources for selectively illuminating in a one to one correspondence said plurality of coupling photoresistors substantially in synchronism with said addressing pulses; and a plurality of decoupling light sources for selectively illuminating in a one to one correspondence said plurality of decoupling photoresistors; said decoupling light sources being respectively illuminated at a predetermined interval subsequent to the illumination of said coupling light sources.

2. The apparatus according to claim 1 further comprising a coupling capacitor coupled between said addressing pulse means and said plurality of coupling photoresistors.

3. The apparatus according to claim 1 or 2 wherein said photoresistors are comprised of materials selected from the group of cadmium sulfide and cadmium selenide.

4. The apparatus according to claim 1 or 2 wherein said plurality of coupling and decoupling light sources comprise self-scanning gas discharge tubes.

5. An improved flat panel display of the type having an AC plasma display panel including a first plurality of parallel conductive leads, and a second plurality of parallel conductive leads, said first plurality of conductive leads so arranged and constructed to form a plurality of intersections with said second plurality of leads, thereby forming a matrix of intersection, comprising:

a first addressing pulse means for providing addressing signals;

a first plurality of coupling photoresistors coupled to said first addressing pulse means;

a first plurality of decoupling photoresistors, each of said decoupling photoresistors coupled to a corresponding one of said plurality of coupling photoresistors;

a first plurality of shunt capacitors coupled in shunt relationship with a corresponding one of said first plurality of decoupling photoresistors;

a first sustaining voltage source means coupled to said decoupling photoresistors, for providing sustaining voltage pulses in synchronism with said first addressing pulses;

a first plurality of output terminals coupled to the junction of said first coupling and first decoupling photoresistors and said first shunt capacitors, each of said output terminals being coupled to one of said AC plasma panel first plurality of parallel conductive leads;

a first means including a first plurality of coupling light sources for selectively illuminating in a one to one correspondence said plurality of first coupling photoresistors substantially in synchronism with said first addressing pulses; and a first plurality of decoupling light sources for selectively illuminating in a one to one correspondence said plurality of first decoupling photoresistors said first decoupling light sources being illuminated at a predetermined interval subsequent to the illumination of said first coupling light sources;

a second addressing pulse means for providing second addressing signals;

a second plurality of coupling photoresistors coupled to said second addressing pulse means;

a second plurality of decoupling photoresistors, each of said second decoupling photoresistors coupled to a corresponding one of said second plurality of coupling photoresistors;

a second plurality of shunt capacitors coupled in shunt relationship with a corresponding one of said second decoupling photoresistors;

a second sustaining voltage source means coupled to said second decoupling photoresistors for providing second sustaining voltage pulses in synchronism with said second addressing pulses;

a second plurality of output terminals coupled to the junction of said second coupling and second decoupling photoresistors and said second shunt capacitors, each of said second output terminals being coupled to one of said AC plasma panel second plurality of conductive leads;

a second means including a second plurality of coupling light sources for selectively illuminating in a one to one correspondence said second plurality of coupling photoresistors substantially in synchronism with said second addressing pulses; and a second plurality of decoupling light sources for selectively illuminating in a one to one correspondence said second plurality of decoupling photoresistors; said second decoupling light source being respectively illuminated at a predetermined interval subsequent to the illumination of said second coupling light sources.

6. The apparatus according to claim 5 further comprising:

a first coupling capacitor coupled between said first addressing pulse means and said first plurality of coupling photoresistors; and a second coupling capacitor coupled between said second addressing pulse means and said second plurality of coupling photoresistors.

* * * * *